United States Patent [19]

Uribe

[11] 4,284,253

[45] Aug. 18, 1981

[54] PNEUMATIC BRAKE ACTUATING SYSTEM

[76] Inventor: Jorge R. Uribe, Caracas, Venezuela

[21] Appl. No.: 80,190

[22] Filed: Oct. 1, 1979

[51] Int. Cl.[3] ..... B66D 1/48

[52] U.S. Cl. ..... 254/271; 188/155; 254/379

[58] Field of Search ..... 254/271, 337, 338, 379, 254/335, 362; 188/155

[56] References Cited

U.S. PATENT DOCUMENTS

| | | | |
|---|---|---|---|
| 2,683,020 | 7/1954 | Nickle | 254/171 |
| 3,677,520 | 7/1972 | Koomey | 254/171 |
| 3,759,489 | 9/1973 | Jones | 254/379 |

*Primary Examiner*—Billy S. Taylor
*Attorney, Agent, or Firm*—Barry L. Haley

[57] ABSTRACT

A manually initiated, brake actuating system for immediate stoppage of the traveling block in a drilling derrick drawworks that overrides a conventional automatic drawwork safety control device. The system includes a normally closed, solenoid-controlled pneumatic valve mounted in an explosive resistant container between the system air supply and the pneumatic brake for the drawworks drum. A manually operated electrical switch, when actuated, simultaneously (1) energizes the solenoid to the emergency override pneumatic valve,and (2) de-energizes the drawworks power circuit, cutting off power to the drawworks motor.

2 Claims, 2 Drawing Figures

PNEUMATIC BRAKE ACTUATING SYSTEM

BACKGROUND OF THE INVENTION

This invention relates generally to a safety device which is utilized with an oil or gas well drilling rig, and specifically to a manually initiated, emergency override system that allows the rig operator or anyone else in the vicinity of the control panel to immediately brake and de-energize the traveling hoist drum when necessary.

At present, well drilling rigs employing a derrick have a safety device for controlling the traveling block coupled to the hoist cable and drum that automatically provides braking action to the drum to prevent the traveling block from being pulled into the crown block mounted near the top of the derrick. One device to accomplish stopping of the traveling block at a safe level is known under the trademark of "CROWN-O-MATIC" and is manufactured by Stewart and Stevenson Oil Tools, Inc. This device has a valve in the pneumatic line that is opened by a mechanical toggle which responds to an extra wrap of cable on the hoisting drum, an indication that the traveling block is positioned too close to the crown block. There are emergency situations, however, that demand immediate stoppage of the traveling block (and shut-down of the drawworks power), either before the extra length of wire or cable has had a chance to wrap on the hoisting drum, or in event of a failure of the cable to wrap properly on the drum.

The present invention is used with the conventional safety device to allow a rig operator or other surrounding personnel under extreme circumstances to immediately brake the hoisting drum and de-energize the drawworks power supply.

BRIEF DESCRIPTION OF THE INVENTION

A manually initiated, emergency override system for immediate stoppage of the traveling block in a well drilling derrick, for use with a conventional drawworks safety device having a cable responsive automatic hoist stop. The present system provides for immediate activation of the hoisting drum brake upon manual initiation of the switch and de-energizing of all power to the drawworks motor.

The system is utilized with the pneumatic brake system presently found on the hoisting drum and includes the installation of a solenoid-actuated valve disposed between the pneumatic power source and the hoisting drum brake. An electrical circuit is provided which has a manually initiated master control switch in series with a power supply and the solenoid of the emergency override valve. The master switch also disconnects the drawworks motor from the drawworks power supply, thus simultaneously deenergizing the system at the same time the emergency override valve is actuated.

The valve itself and the associated circuit elements may be mounted in an explosion-proof receptacle to insure its operation in the event of a well explosion or fire. Because the emergency override system is non-complex in structure, it is readily adapted for installation into the conventional automatic safety device even as a field modification.

It is an object of this invention to provide an emergency override system that is manually initiated that can override the automatic safety device found in a drilling derrick drawworks.

It is another object of this invention to provide an emergency safety device that can be readily installed in present conventional automatic safety devices for the drawworks of an oil drilling rig.

But yet still another object of this device is to provide a safety device which allows an operator or other personnel to immediately stop the traveling block in a derrick drawworks system.

PREFERRED EMBODIMENT OF THE INVENTION

Figure 1:
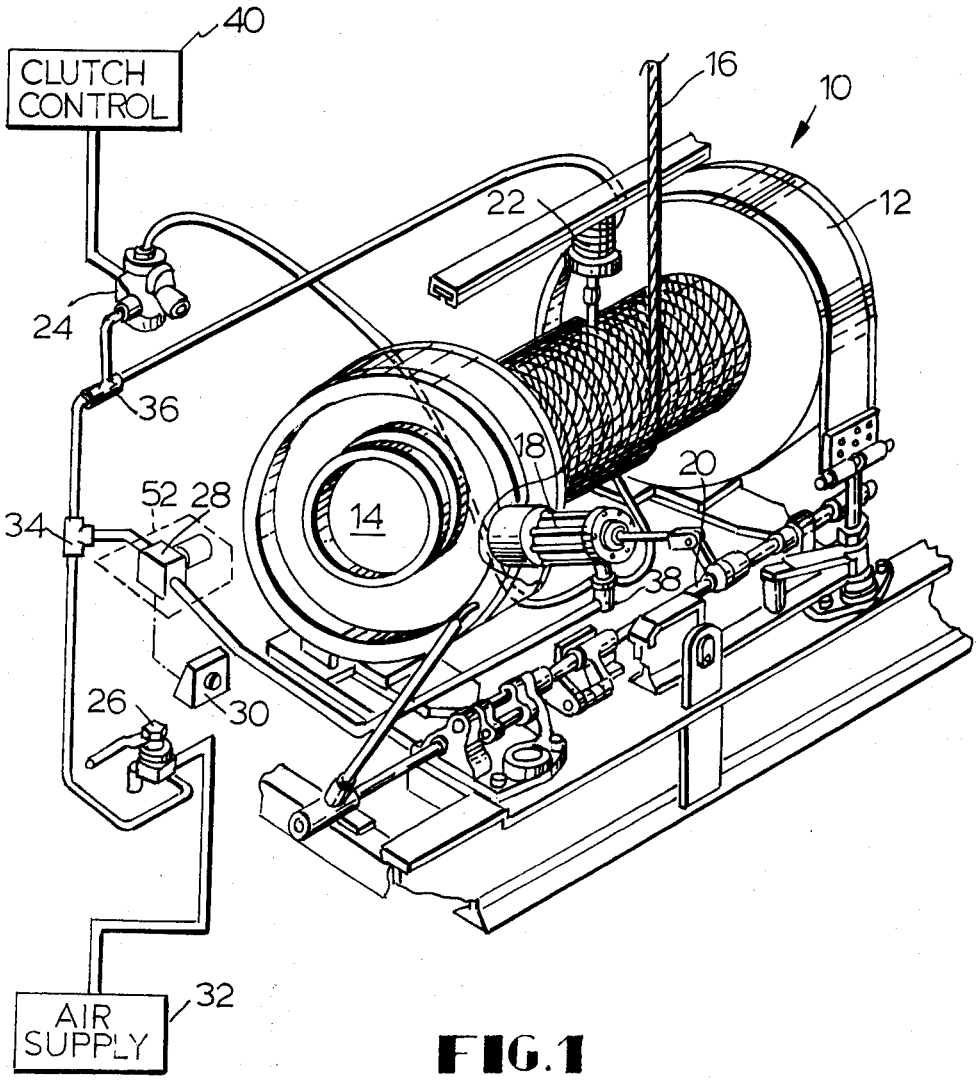
FIG. 1 shows a perspective view of the present invention installed in a conventional automatic drawworks safety device.

Referring now to the drawings, especially FIGS. 1 and 2, an automatic safety device for a hoisting drum is shown generally at 10 employed with the present invention which is described in greater detail below. Essentially the hoisting drum 14, which is connected to a motive drive force (not shown), includes a cable 16 that is coupled to the traveling block through the crown block in the derrick (not shown). The hoisting drum includes a clutching linkage shown generally at 20 which is attached to a pneumatic cylinder 18 and to the clutch and brake band 12 which is regulated by air supply 32 to the pneumatic cylinder 18. The automatic safety device as shown with the modifications of the present invention is essentially the safety device manufactured by Stewart and Stevenson Oil Tool, Inc., known under the trademark of CROWN-O-MATIC. The system has been modified by the addition of the solenoid actuated valve 28 that is housed in an explosive-proof or resistant container 52 connected in a pneumatic line between conduit T-section 34 and the inlet conduit junction 38 directly connected into the pneumatic cylinder 18. The emergency override valve 28 is connected by a pneumatic conduit line through valve 26 which is normally open to the system air supply 32. The system air supply is also connected to a relay valve 24 through conduit T-section 36 which has an outlet line to the clutch control panel 40 and into the pneumatic cylinder 18. Also connected to the air supply is the automatic toggle valve 22 that responds to an extra wrap of wire on the hoisting drum 14.

Figure 2:
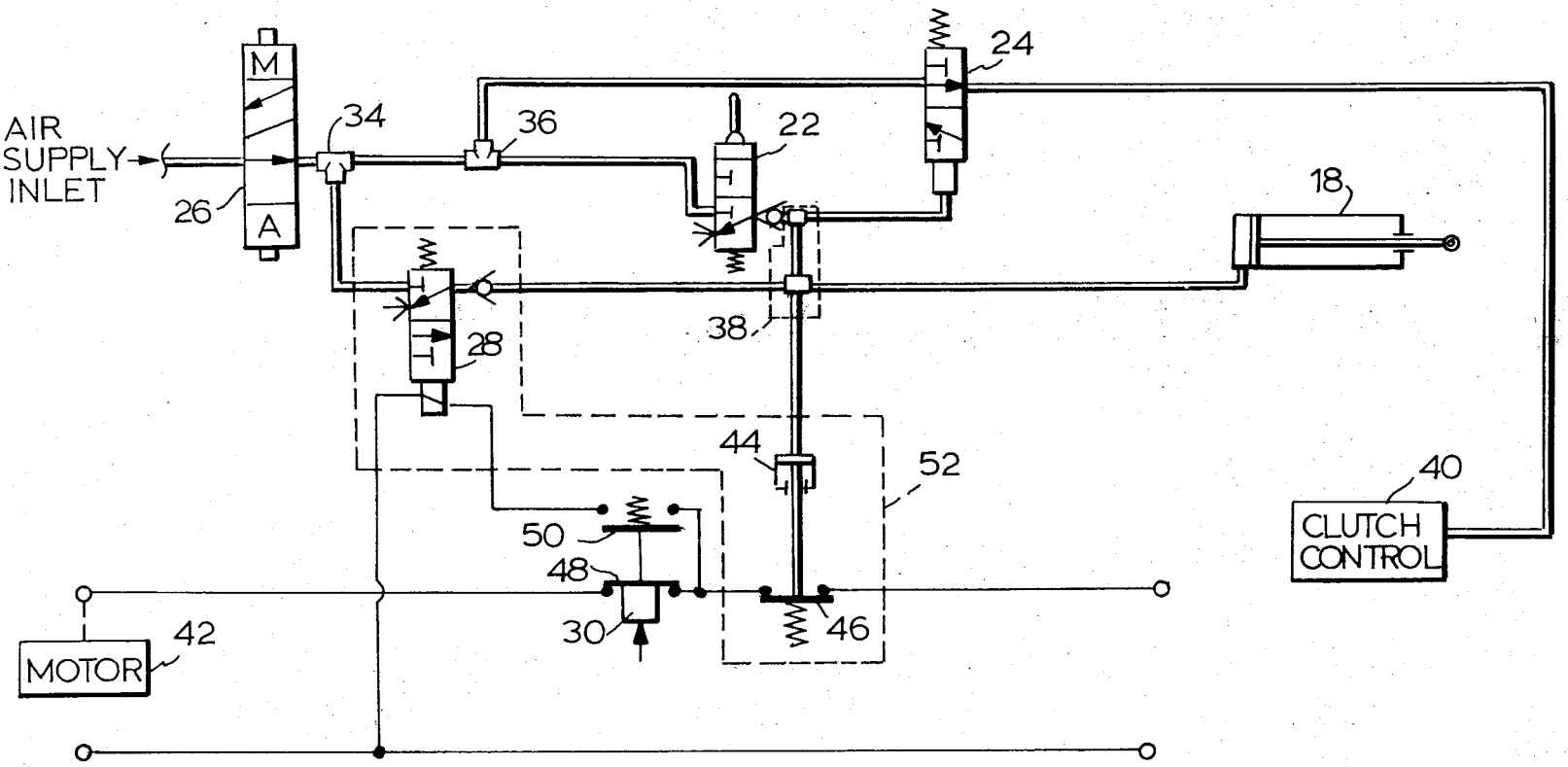
FIG. 2 shows a schematic diagram of the present invention shown in FIG. 1.

The manually initiated switch 30 is electrically connected to the solenoid which operates the emergency override valve 28 and also to the drawworks power circuitry (FIG. 2).

In the normal operation of the drawworks, the emergency override valve 28 is closed. The inlet air supply to the system, which may be approximately 150 p.s.i., passes through the manual, normally opened valve 26. The system air supply is supplied to the relay valve 24 which goes to the clutch control panel and to the toggle valve 22, normally closed during system operation. In the event of an extra wrap of cable, the toggle valve 22 will be opened, providing air to brake cylinder 18 which tightens the braking belt 12. Power to the drawworks is provided on a conventional power supply to the motor 42 through normally closed switches 46 and 48. In the event of an emergency which requires immediate override, even of the automatic system, the console operator or rig operator or any other person in the area merely depresses button 30, which (1) instantly opens switch 48 and the power supply line to motor 42 or other drawworks operation, and (2) closes switch 50, which provides electrical current to the solenoid in valve 28, forcing the valve to an open position. This provides instant system air pressure directly into the pneumatic cylinder 18 connected to the brake band 12, forcing immediate braking action on the hoisting drum.

In the operation of the normal automatic system, an additional pneumatic piston 44 is provided that upon activation of the toggle valve 22, pneumatic power would be received in piston 44 causing the power line to the drawworks power through switch 48 to be open. However, using the present system, the manual initiation of switches 48 and 50 by button 30 would insure cut-off of drawworks power. However, once the air pressure is supplied to the system, this will insure that power will not be returned to the drawworks since the piston 44 will be depressed, opening the switch 46.

It can be seen in FIG. 1 how the installation of the emergency override valve 28 can be readily accomplished by providing a conduit "T" 34 and additional pneumatic lines between the valves, the air supply and the pneumatic cylinder 18. Also, electrical circuitry, non-complex in nature, and switching devices can be readily added at relatively low cost.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An emergency, manually-initiated override system for pneumatic brake on the hoisting drum in a drilling drawworks, said drawworks having an automatic braking system that includes an air supply, an electrical power supply, a toggle actuated valve in conjunction with the cable and hoisting drum of the drawworks responsive to an extra wrap of cable on the hoisting drum, the system comprising:

a solenoid actuated valve disposed between the air supply of said system and the pneumatic brake of the hoisting drum, said valve normally being in a closed position;

a first electrical switch connected between the electrical power supply and the solenoid of said emergency override valve, said electrical switch being closed to complete the circuit to provide power to the solenoid for opening the pneumatic line; and a second electrical switching means connected to said first electrical switching means and to said drawworks electrical power supply for disengaging the drawworks power supply from the drawworks.

2. A system as in claim 1, wherein:

said emergency override valve is housed within an explosive resistant container.

* * * * *